United States Patent [19]

Prince, Jr.

[11] 4,044,458

[45] Aug. 30, 1977

[54] METHOD OF MAKING A POWER-PACK ASSEMBLY

[75] Inventor: Luther T. Prince, Jr., Minneapolis, Minn.

[73] Assignee: Ault Incorporated, Minneapolis, Minn.

[21] Appl. No.: 678,078

[22] Filed: Apr. 19, 1976

Related U.S. Application Data

[62] Division of Ser. No. 547,781, Feb. 7, 1975, Pat. No. 3,979,707.

[51] Int. Cl.[2] ..... H01F 41/10

[52] U.S. Cl. ..... 29/605; 29/628

[58] Field of Search ..... 29/605, 628, 602; 336/192, 198, 208; 339/256 SP, 258 S, 276 A

[56] References Cited

U.S. PATENT DOCUMENTS

| | | | |
|---|---|---|---|
| 2,802,193 | 8/1957 | Biba, Jr. et al. | 336/192 X |
| 3,215,975 | 11/1965 | Kinkaid | 339/256 SP |
| 3,359,520 | 12/1967 | Foerster | 29/605 X |
| 3,691,425 | 9/1972 | Weyrich et al. | 336/192 X |
| 3,813,763 | 6/1974 | Church | 29/596 |
| 3,974,407 | 8/1976 | Dochterman | 336/192 X |
| T920,007 | 3/1974 | Cator | 336/192 X |

*Primary Examiner*—Carl E. Hall
*Attorney, Agent, or Firm*—Lindquist & Vennum

[57] ABSTRACT

A power-pack assembly including a bobbin, at least primary and secondary windings wound on the bobbin and a core carried by the bobbin. Solderless connection devices are secured to the bobbin and electrically connected to the windings. The solderless connection devices include clips which engage input and output terminals to make an electrical and mechanical connection therewith. In a preferred embodiment, the terminals are carried by a terminal block which provides a single step plug-in connection between the connection devices and the terminals. A core-grounding system is also disclosed which includes a core-grounding terminal, a spring for electrically contacting the core and a clip secured to the bobbin for engaging the core-grounding terminal and maintaining it in electrical contact with the spring. The core-grounding terminal may be carried by the terminal block for plug-in connection to its clip during the single step plug-in connection of the solderless connection devices and the input and output terminals.

3 Claims, 4 Drawing Figures

METHOD OF MAKING A POWER-PACK ASSEMBLY

This is a division of application Ser. No. 547,781, filed Feb. 7, 1975, now U.S. Pat. No. 3,979,707.

BACKGROUND OF THE INVENTION

Power packs, such as transformers and the like, are known to the prior art for reducing line voltage and providing alternating current, direct current or battery charger operation. For example, power packs for small appliances in which the line voltage is reduced to 12 volts and rectified to produce a DC voltage are in common use. In other forms, power packs are commonly employed to recharge the batteries, typically nickel cadmium systems, which are used for powering small appliances.

While power packs have wide application, the many operations necessary in their assembly results in a relatively high cost. Among the operations which have contributed to this cost is the soldering required to establish an electrical communication between the power-pack windings and the input and output terminals. In those instances where the power-pack core is to be grounded, this requirement compounds the problem by adding yet another soldering operation.

SUMMARY OF THE PRESENT INVENTION

The present invention provides a power-pack assembly of the type having a bobbin, at least primary and secondary windings wound on the bobbin and a core carried by the bobbin in a manner known to the prior art. Solderless connection devices are secured to the bobbin and engage the input and output terminals to make an electrical and mechanical connection therewith. These solderless connection devices also provide for an electrical contact with the appropriate windings so as to electrically interconnect the windings and the terminals. In a preferred embodiment, the terminals are carried by a terminal block to provide a solderless, one step plug-in connection of the terminals and the solderless connection devices. An additional solderless connection device may be provided to engage a core-grounding terminal, the core grounding terminal being electrically connected to the core by means of a spring. The core-grounding terminal may also be carried by the terminal block for plug-in connection to its solderless connection device.

DETAILED DESCRIPTION OF THE INVENTION

Figure 1:
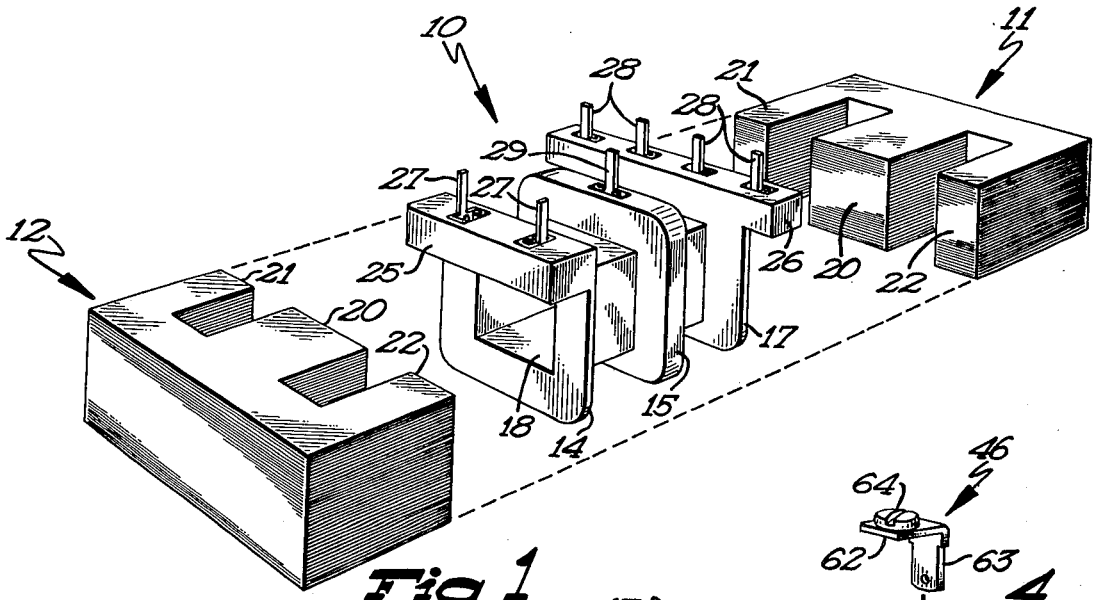
FIG. 1 illustrates a portion of a preferred embodiment of the present invention.

FIG. 1 illustrates a bobbin 10 into which core members 11 and 12 are to be inserted. The bobbin 10 contains a spool portion upon which primary and secondary windings are to be wound, the primary winding section 13 being defined by flanges 14 and 15 and the secondary winding portion 16 being defined by flanges 15 and 17.

A core-accepting aperture 18 extends through the spool portion of the bobbin 10.

The provision of the spool portions 13 and 16 and the winding of primary and secondary windings thereon are known to the prior art. Similarly, the provision of the aperture 18 for accepting the core is known to the prior art. However, typical prior art core members have included one E member and a bar. Within the present invention, it has been found advantageous to employ two E shaped core members 11 and 12 inserted through opposing ends of the aperture 18 and into electrical contact within the aperture 18. For this purpose, the core members 11 and 12 are laminated structures each having a central projection 20 and side projections 21 and 22. The central projections 20 are inserted from opposing sides of the apertures 18 and into electrical contact within the aperture 18. The side projections 21 and 22 lie alongside the flanges 14, 15 and 17 and electrically contact the side projection of like reference numeral of the other core member. The flanges 14 and 17 are provided with shoulders, 25 and 26, respectively, under which the core members 11 and 12 lie when their central projections 20 are fully inserted within the aperture 18.

The shoulder 25 is provided with two recesses in its upper surface in which solderless connection devices 27 are secured. Similarly, the upper surface of shoulder 26 is provided with recesses in which solderless connection devices 28 (four shown) are secured. The flange 15 has an aperture running from its upper surface through to the central aperture 18 in which a solderless connection device 29 is secured.

Figure 2:
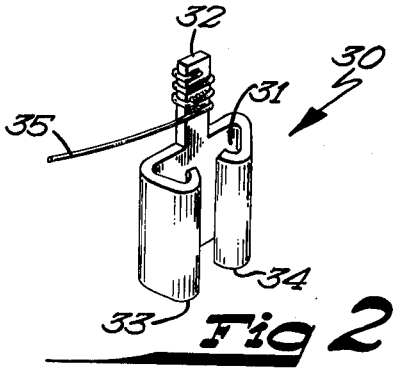
FIG. 2 illustrates a component used within the preferred embodiment of FIG. 1.

A solderless connection device typical of that illustrated at 27, 28 and 29 in FIG. 1 is illustrated in FIG. 2. It is to be understood that the various solderless connection devices illustrated in FIG. 1 may have different size requirements. However, in spite of any size differences, those solderless connection devices may be identical in configuration with the solderless connection device illustrated in FIG. 2. The solderless connection device 30 in FIG. 2 has a clip portion 31 and an electrical connection portion or tang 32. The clip portion 31 is provided with two tabs 33 and 34 which curl back over the central body of the clip portion 31 such that a member inserted between the central body of the clip 31 and the ends of the tabs 33 and 34 will be frictionally engaged by the tab ends and central body and mechanically secured in position. The solderless connection devices 30 are of a conductive material, preferably metal to assure a positive securement of a member inserted within the clip portion 31. The electrical connection portion or tang 32 may be unitary with the clip portion 31 and its use will be described more fully below in conjunction with the lead 35.

The recesses within the upper surfaces of the shoulders 25 and 26 and the aperture through the flange 15 are configured such that the solderless connection device positioned therein will have their tab portions 33 and 34 (see FIG. 2) slightly compressed. In this manner, the solderless connection device is secured, as by friction, within the recess or aperture. The securement of the solderless connection devices within the apertures and recesses may be further understood by reference to a press fit.

Figure 3:
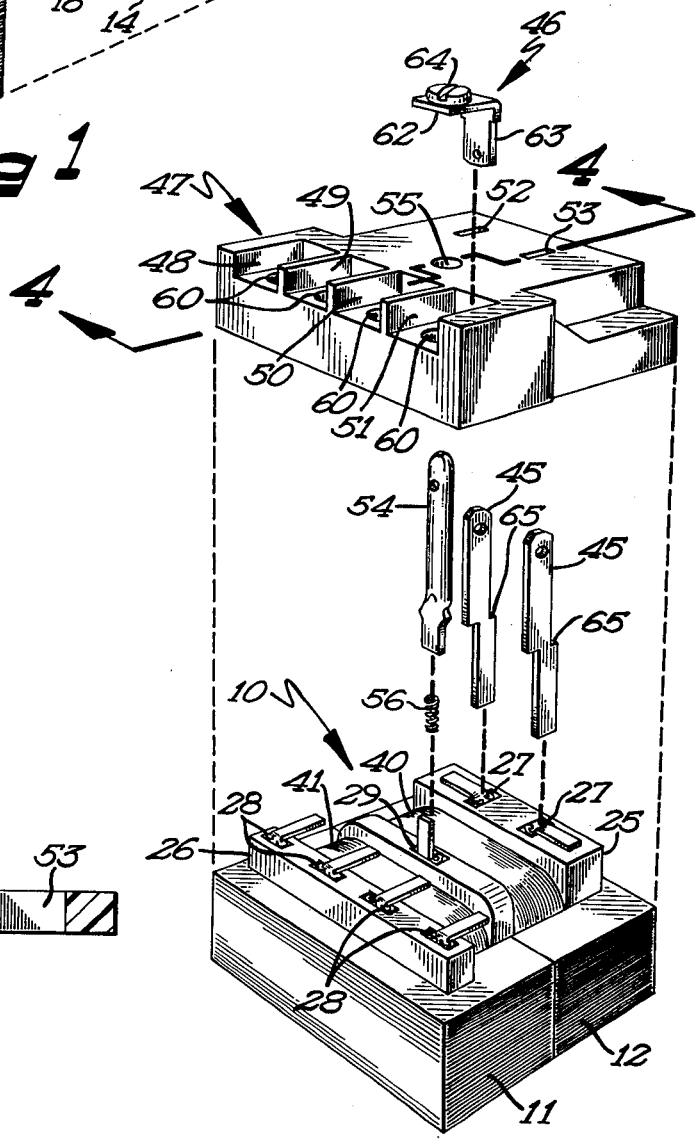
FIG. 3 illustrates the assembly of the power pack of the present invention.

Referring now to FIG. 3, there is shown the bobbin 10 having a primary winding 40 wound on the spool portion 13 and a secondary winding 41 wound on the spool portion 16. The core members 11 and 12 are in operative positions with respect to each other and the bobbin 10 and solderless connection devices 27-29 are press fit within their recesses or apertures as described with reference to FIGS. 1 and 2. The tangs of the solderless connection devices 27, which correspond to the portion 32 of the connection device illustrated in FIG. 2, are adapted for connection to different ends of the primary winding 40 in the manner illustrated in FIG. 2. That is, a lead 35 corresponding to one end of the winding is wound around the tang 32 (see FIG. 2). The winding end should be stripped so as to establish an electrical communication between the connection device tang and the winding. After the winding ends have been wound around the tangs of the connection devices 27, those tangs may be flattened against the upper surface of the shoulder 25. Similarly, the two ends of the second winding 41 are each wound around the tangs of a different one of the solderless connection devices 28. Of course, this will require only two secondary solderless connection devices. However, additional connection devices may be provided for making electrical connection to center taps of the secondary winding 41, the center taps being known to the prior art. After the exposed leads from the secondary winding 41 are wound around the tangs of the solderless connection devices 28, those tangs may be flattened as illustrated in FIG. 3. With the solderless connection devices 27 and 28 secured to the bobbin and connected to their respective winding 40 or 41, input terminal members 45 may be inserted within the clip portions of the solderless connection devices 27 which mechanically and electrically engage the terminals 45 to electrically interconnect them with the primary winding 40 and secure them within the bobbin 10. Similarly, output terminals 46 may be inserted within the clip portion of the solderless connection devices 28 to electrically interconnect them with the secondary winding 41 and secure them within the bobbin 10.

A terminal block 47 is configured to carry the input terminals 45 and output terminals 46 such that the terminals may be secured to their respective solderless connection devices, 27 and 28, in a single step plug-in operation. The terminal block is provided with apertures 52 and 53 and recesses 48–51. The input terminals 45 are inserted through the apertures 52 and 53 from the underside of the terminal block 47 with the shoulders 65 of the input terminals 45 in abutment against the underside of the terminal block 47. The apertures 52 and 53 are configured to frictionally engage the input terminals 45 and retain them in position and the shoulders provide a bearing surface for transmitting a force applied to the terminal block 47 to the input terminals 45.

Figure 4:
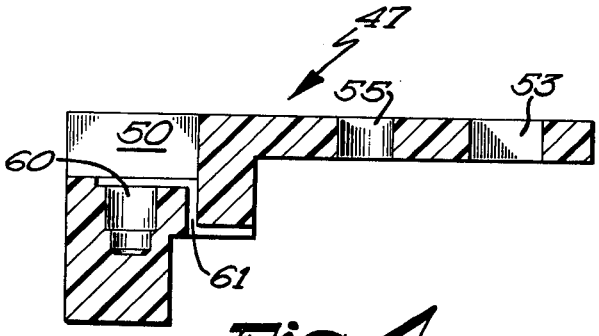
FIG. 4 illustrates a cross section of one of the components of FIG. 3.

Output terminals 46 (one shown) are formed as an angle having a first leg 62 and a second leg 63. The leg 62 is configured to lie on the upper surface of one of the recesses 48–51, and is bored and tapped to accept the threads of a bolt 64. The bolt 64 extends through the leg 62 of the terminal 46 and into a bore 60 in the upper surface of the recess. FIG. 4 is a cross section of the terminal block 47 taken through the recess 50 and its bore 60, the aperture 53 and an aperture 55 whose function will be explained below. In FIG. 4, an aperture 61 is shown extending from the upper surface of the recess 50 to the underside of the terminal block 47. The aperture 61 is configured to accept the leg 63 of the output terminal 46 when the leg 62 is within the recess 50 and to retain the leg 63 in position against a force at least as great as that necessary to insert the end of the leg 63 within one of the solderless connection devices 28. The leg 63 may also be secured by a pin or any other convenient device or substance. However, a press fit of the leg 63 within the aperture 61 which will hold against a force sufficient to insert the end of the leg 63 within one of the connection devices 28 has proven satisfactory.

With the input terminals inserted through the apertures 52 and 53 and the output terminals 46 within each of the recesses 48–51 with their legs 63 press fit in, and extending through, the apertures 61, the terminal block 47 is positioned over bobbin 10 with the terminals 45 aligned with the connection devices 27 and the terminals 46 aligned with the connection devices 28. A force applied to the terminal block 47 will be transmitted to the terminals 45 and 46 driving them into mechanical and electrical engagement with their respective connection devices. In this manner, all of the terminals 45 and 46 are secured to their connection devices in a single step plug-in operation. Following this securement, the power-pack assembly may be encapsulated, in known manner, as by potting.

In many instances, it is necessary or desirable to ground the core formed by the core members 11 and 12. For this purpose, a core-grounding terminal 54 having flanges 66 is inserted through the aperture 55 in the terminal block 47 until the flanges 66 are in abutment against the underside of the terminal block 47. The aperture 55 frictionally engages the terminal 54 to hold it in place and the flanges 66 function in a manner similar to the shoulders 65. A spring 56 is inserted through the aperture in which the solderless connector 29 is secured and into contact with the core within the bobbin aperture 18 (see FIG. 1). The spring 56 may be configured to slip past the clip portion of the solderless connector 29 through either of its curved tabs or the space between them. When the core-grounding terminal 54 is inserted within the solderless connection device 29 it contacts the spring 56 and establishes an electrical communiction between the core-grounding terminal 54 and the core. The resiliency of the spring 56 permits the core-grounding terminal 54 to be inserted to a depth within the solderless connection device 29 which will assure an electrical contact of the spring 56 and the core without damage to either the core of the core-grounding terminal 54. The core-grounding terminal 54, being carried by the terminal block 47, will be inserted within the connection device 29 and secured to the bobbin 10 during the single step plug-in operation of securing the terminals 45 and 46 to the connection devices 27 and 28, respectively.

Obviously, many modifications and variations of the present invention are possible in light of the above teachings. For example, the input terminals 45 and core-grounding terminal 54 are illustrated for cooperation with a conventional wall outlet and are configured and spaced accordingly. However, the solderless connection devices, input and output terminals and the terminal block carrying those terminals may be configured for any desired application without departing from the scope of the present invention. Also, as many center taps as are desirable may be employed within the secondary winding 41 to provide as many variable secondary outputs as desirable. Alternatively, a plurality of the output terminals may be interconnected to the same output potential by winding more than one of the secondary solderless connection devices with the end of the secondary winding. Additionally, as many windings as are desired may be employed and connected to output terminals, in the manner disclosed, without departing from the scope of the present invention. It is therefore to be understood that, within the scope of the appended claims, the invention may be practiced otherwise than as specifically described.

What is claimed is:

1. The method of simultaneously establishing a mechanical and electrical connection between the windings and multiple terminals of a power-pack assembly which comprises the steps of:

forming a bobbin having a spool portion and a plurality of recesses in its surface;

winding at least primary and secondary windings on said spool portion;

forming solderless terminal engagement means of a conductive material, each having a female clip portion and a tang portion extending from said clip portion;

securing the clip portion of different terminal engagement means within at least some of said recesses, said tang portions extending, in the same direction, away from said recesses and said bobbin surface;

establishing an electrical contact between said tang portions and said windings;

forming a terminal block;

mounting a plurality of terminals on said terminal block in a configuration which may be aligned with the clip portions secured within said recesses;

aligning said terminals and clip portions;

forcing said terminals into said clip portions from the direction of extension of said tang portions by a force imparted to at least one of said bobbin and terminal block, said clip portions frictionally engaging said terminal means and said terminal means extending from said clip portions in the direction of extension of said tang portions.

2. The method of claim 1 further comprising the step of bending the tang portions to lie generally at the surface of said bobbin, the step of bending being performed after the step of establishing.

3. The method of claim 1 wherein the step of mounting comprises the step of inserting a plurality of terminals through said terminal block.

* * * * *

UNITED STATES PATENT AND TRADEMARK OFFICE

CERTIFICATE OF CORRECTION

PATENT NO. : 4,044,458

DATED : August 30, 1977

INVENTOR(S) : Luther T. Prince, Jr.

It is certified that error appears in the above-identified patent and that said Letters Patent are hereby corrected as shown below:

Column 2, Line 16, "apertures 18" should read --aperture 18--.

Column 3, Line 16, "second" should read --secondary--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*